United States Patent [19]

Saxton et al.

[11] Patent Number: 4,930,426

[45] Date of Patent: Jun. 5, 1990

[54] DEVICE FOR CHANGING THE EFFECTIVE WIDTH OF A CONTAINER WELL OF A FREIGHT CAR

[75] Inventors: Gregory J. Saxton, Portland; Gary S. Kaleta, Warren, both of Oreg.

[73] Assignee: Gunderson, Inc., Portland, Oreg.

[21] Appl. No.: 278,616

[22] Filed: Nov. 30, 1988

[51] Int. Cl.[5] ..... B61D 45/00; B60P 1/64

[52] U.S. Cl. ..... 105/355; 105/411; 410/54; 410/94

[58] Field of Search ..... 410/54, 77, 82, 94, 410/121; 105/355, 396, 385, 404, 411

[56] References Cited

U.S. PATENT DOCUMENTS

| | | | |
|---|---|---|---|
| 1,737,777 | 1/1927 | Mayer . | |
| 3,415,205 | 8/1967 | Gutridge | 105/366 |
| 3,444,824 | 8/1967 | Gutridge | 105/366 |
| 3,762,340 | 10/1973 | Udaloff | 105/366 |
| 3,805,709 | 4/1974 | Schuller et al. | 105/366 |
| 4,624,188 | 11/1986 | Kaleta | 410/94 |
| 4,648,764 | 3/1987 | Pavlick | 410/77 |
| 4,754,709 | 7/1988 | Gramse et al. | 105/355 |

*Primary Examiner*—Andres Kashnikow
*Assistant Examiner*—V. Lissi Mojica
*Attorney, Agent, or Firm*—Chernoff, Vilhauer, McClung & Stenzel

[57] ABSTRACT

An adjustably positioned container guide and spacer device to be mounted on a side wall defining a container well of a railroad car for receiving intermodal cargo containers of different widths, the device acting as a guide during loading of a container into the container well, and acting to restrain a container, particularly one narrower than the width of the container well, to prevent such a container from moving laterally too far once it has been placed within the container well. A sloping guide surface and a blunt, convexly curved spacer nose surface of the guide body are presented so as to guide a container to the proper location within a container well, and the nose surface thereafter prevents the container from moving an excessive distance laterally within the container well when the guide body is latched in the correct one of the available inner and outer positions, as determined by the width of the container. A latch bar permanently but movably held in the guide body is ordinarily held in a selected latching position by the force of gravity, but is upwardly movable to disengage the latch and permit relocation of the guide body.

24 Claims, 2 Drawing Sheets

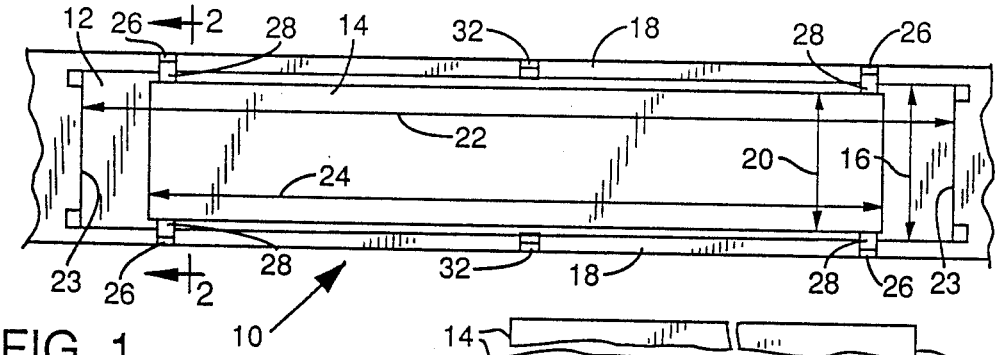
FIG. 1
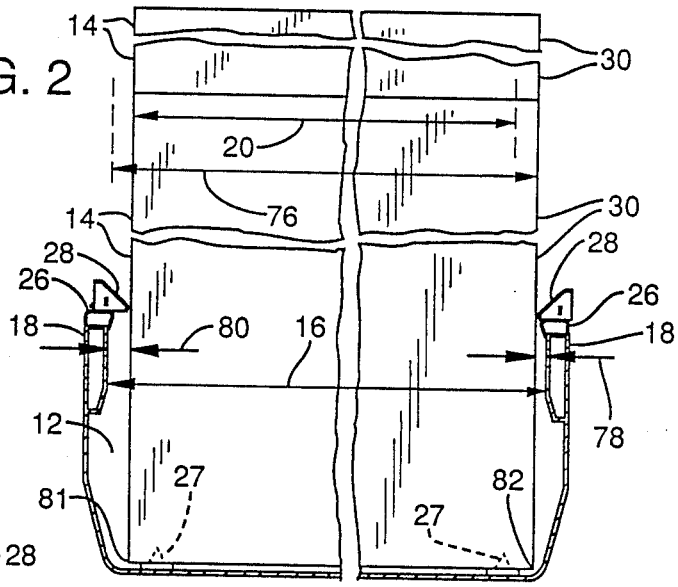
FIG. 2
FIG. 3
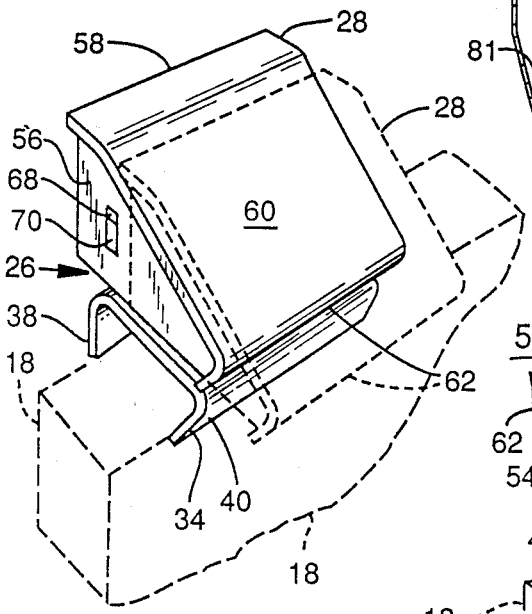
FIG. 4
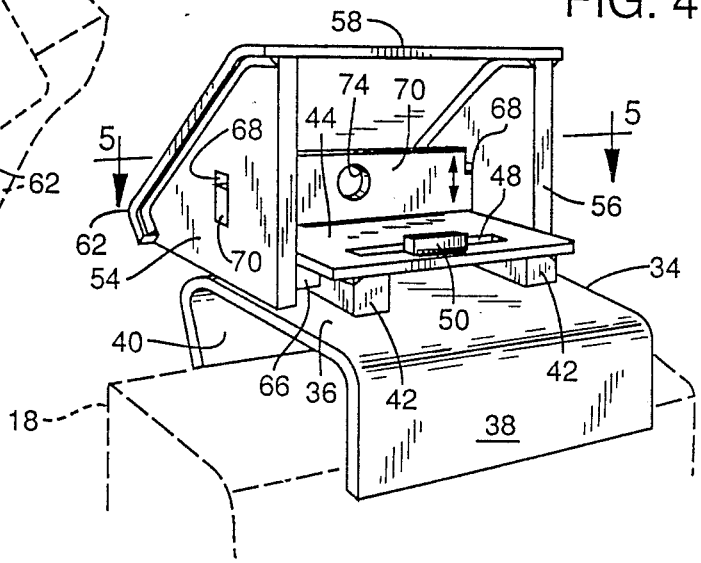

DEVICE FOR CHANGING THE EFFECTIVE WIDTH OF A CONTAINER WELL OF A FREIGHT CAR

BACKGROUND OF THE INVENTION

The present invention is related to railroad freight cars, and particularly to well cars intended to carry intermodal cargo containers in a container well which surrounds a lower portion of a cargo container.

Intermodal cargo containers, designed to be carried interchangeably on highway truck chassis, in containership holds, and on specially designed railroad cars, are constructed in several sizes, some of which are commonly used in international commerce. Until recently, most such containers have had a standard width of about 96 inches. Some intermodal cargo containers have more recently been built in a greater width of about 102 inches. Various lengths of cargo containers have long been available, and various railroad cars including container wells have been built to accommodate containers of different lengths interchangeably, although most have been built to carry containers no more than about 96 inches in width, since it is necessary for a railroad car to be narrow enough to fit within the available clearances along the track.

It is naturally desirable to be able to carry containers of different sizes in the container well of a railroad car, depending upon what containers are available to be carried, rather than having the railcar stand idle because of a mismatch of railcar and container sizes. Previously railcars have therefore been able to carry containers of different lengths, such as 20 feet, 40 feet, 45 feet, and 48 feet in length. Most containers are provided with strengthening and corner securing devices whose placement is based on the standard 40-foot container length, so that longitudinal placement of containers in the container well of a railcar is not generally a problem. However, the height of the side sills and the related depth of the container well are small enough in some railcars designed to carry containers of 102-inch width that there is room for a 96-inch-wide container to tip sideways and roll out of the container well, rotating about a longitudinal axis and pivoting about the top of the side sill of the car, unless provision is made to restrain the container against lateral movement.

An early attempt to restrain a container laterally, by providing a spacer structure in the side sill of a container car including a well, was disclosed in Pavlick, U.S. Pat. No. 4,648,764, which shows a spacer which can be placed between the side wall of a car and a container located within a container well. However, the spacer taught by Pavlick is apparently located near the bottom of a container carried in the well and would apparently not do anything to prevent the possibility of the container rolling from its intended place within the container well.

Gramse, et al., U.S. Pat. No. 4,754,709, provides a adjustable guide and spacer designed to be located at the top of a side sill of a container well car to take up the additional space available when a narrow container, e.g. 96 inches wide, is placed within a container well designed to be able to accept wider containers, e.g. 102-inch wide containers.

During the process of loading containers into the container wells of railway cars, a container crane operator attempts to align the container accurately with the well into which it is to be placed, but small errors in placement are nevertheless likely. It is therefore common to provide inclined guides affixed to the top of each side of the container well to center a container of a certain width laterally with respect to the well. However, when a car including a container well of a certain width is used to carry a narrower container than normal, a fixed guide of this sort would not be effective.

It is therefore desired to provide a guide to center containers with respect to the side walls of a container well, so that both wider containers and narrower containers will be centered within the container well during loading and will be retained in that location during carriage. However, there is ordinarily no need for such a guide to extend laterally very far outward when a standard container is being loaded into a well wide enough to accept wider containers. Provision of an unnecessarily large guide device merely adds undesirable weight to the car.

Ideally, when a container of standard width is to be loaded into a wider container well, a guide will have previously been placed on the inner side of the side sills of the well to ensure that the container will be placed centrally in the container well. Furthermore, a stabilizing device or spacer will have been placed between the container and the inner face of the side of the container well, so that the container will be prevented from tipping sideways. If a spacer has not been so placed, however, a spacer according to the prior art such as the Pavlick or Gramse, et al. patents mentioned above apparently could not be placed in the desired position between the container and the interior of the container well after a container has been loaded into the container well. As a result, the container would have to be removed from the container well during adjustment of the spacer and thereafter would have to be reloaded into the container well.

What is needed, then, is an adjustable device for guiding either a wider or a narrower container into a central location in a wider container well of a freight car, and then preventing the container, particularly a narrower container, from rolling out of the well. Such a device should not add excessive weight to the railcar, yet should be adequately sturdy to resist lateral movement of a container narrower than the container well, to prevent it from tipping. A container restraining spacer portion of the device should be movable into a position effective to prevent lateral movement of a container which has already been placed into the well, without requiring prior removal of the container to accomplish such adjustment.

SUMMARY OF THE INVENTION

The present invention answers the need for a guide for placement of narrower cargo containers centrally in wider container wells of railroad cars and a support to limit lateral movement of such a container once in place in a container well, by providing a container guide and spacer device including a guide body whose location is adjustable, between an outer position and an inner position. At least one and preferably two or more of these devices are to be provided on each side of a container well of a car. In the outer position the guide body is located laterally with respect to the container well of a railroad car so as to provide clearance for loading wide containers into the container well. In the inner position the guide body effectively narrows the space available in the container well for receiving a container of a lesser width and prevents such a container, once loaded into the container well, from moving laterally a significant distance.

In a preferred embodiment of the present invention a sturdy latch prevents the guide and spacer device from moving from the selected position. The latch is of an uncomplicated design so that it is not likely to become jammed or be made inoperable by corrosion during the normal lifetime of a car equipped with such a guide and spacer device. The guide body of the guide and spacer device of preferred embodiment of the present invention includes a sloping guiding surface which assists in directing a container toward the proper central location as it is lowered into the container well of the car.

A blunt rounded nose of the guide body is located below the sloping guiding surface and faces laterally inward toward the center of the container well. The guide body acts as a spacer, with the blunt nose directed inwardly of the container well to restrain a narrow container and prevent it from rolling out of the container well, as the convexly curved surface of the spacer nose remains directed toward a vertical side of the container to prevent excessive movement of the container. The shape of the spacer nose makes it very unlikely that the guide and spacer device would catch the side or a corner casting of the container in such a way as to make removal of the container from the container well difficult.

In one embodiment of the present invention a container guide and spacer device includes a base which is mounted astraddle the top of the side sill defining a side of a container well of a railway freight car. A guide body is mounted slidably atop the base, so as to be movable laterally of the car between a first or outer position for a wider container and a second, or inner, position for guiding a narrower container into a central location within the container well and thereafter preventing excessive lateral movement. Thus, the generally planar guide surfaces will be inclined downwardly and inwardly toward the interior of the well when the guide body is in either of the two positions.

A latch is provided, in the form of a slidable latching bar preferably extending normal to the direction in which the guide body is slidable on the base, with the ends of the latching bar being engaged in a pair of generally vertical slots defined in the guide body. A portion of the latching bar can be engaged selectively in either of a pair of latch engagement sockets defined in the top of the base, to hold the guide and spacer body in a selected one of the positions. The adjustable guide and spacer device can thus guide either a wider or a narrower container into a central location in the container well and thereafter hold the container in such a position in the container well. Additionally, positive stops are provided atop the base to limit the movement of the guide body, preferably by engaging the latching bar, regardless of whether the bar is engaged in one of the latch engagement sockets or is raised to permit the guide body to be moved.

Accordingly, it is a principal object of the present invention to provide an improved guide and spacer device for varying the effectively available width of a container well of a container-carrying railway car.

It is another important object of the present invention to provide a device having surfaces for guiding a container of either of two different widths positively into the proper location within a container well of a railcar.

It is a feature of the present invention that it includes a sturdy and easily operated latch for dependably holding a guide body and spacer in a selected one of at least two different operative positions.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a simplified top plan view of a portion of a container-carrying well car including a cargo container having a width narrower than the well.

FIG. 2 is a sectional view of the well car shown in FIG. 1, at an enlarged scale, taken along line 2—2 and showing portions of containers of different widths, as well as guide and spacer devices according to the present invention in respective positions for receiving and steadying the containers within the container well of the car.

FIG. 3 is a front perspective view of a guide and spacer device for adjusting the width of a container well of a railway freight car in accordance with the present invention.

FIG. 4 is a rear perspective view of the device shown in FIG. 3, taken from the opposite end.

DETAILED DESCRIPTION OF THE PREFERRED EMBODIMENT

Figure 5:
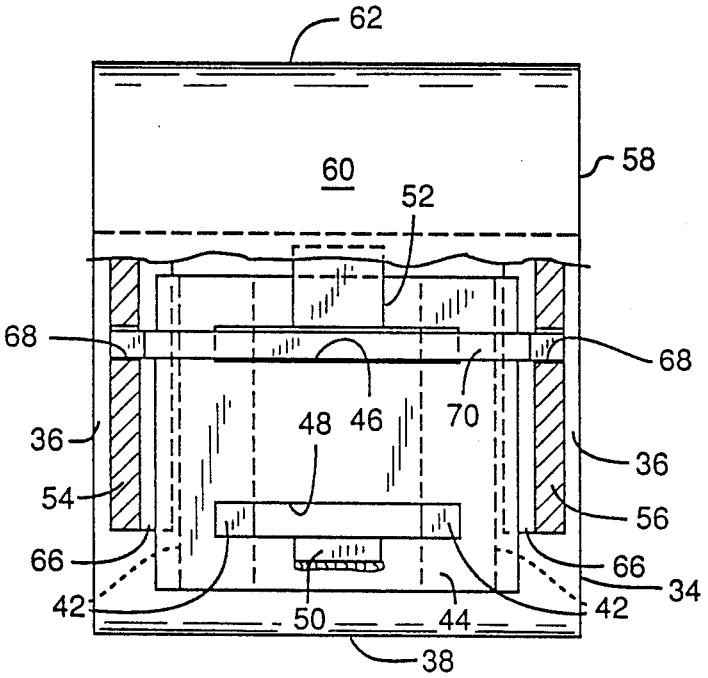
FIG. 5 is a partially cutaway top plan view of the device shown in FIGS. 3 and 4
Figure 6:
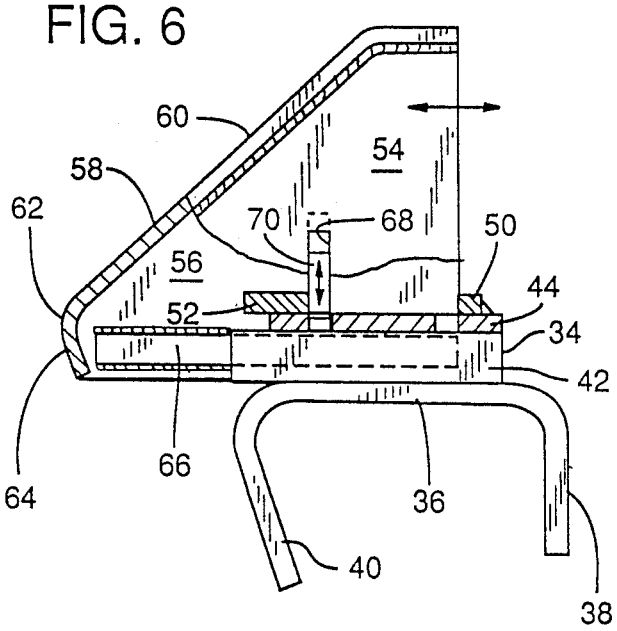
FIG. 6 is an end elevational view of the guide and spacer device shown in FIGS. 3–5.
Figure 7:
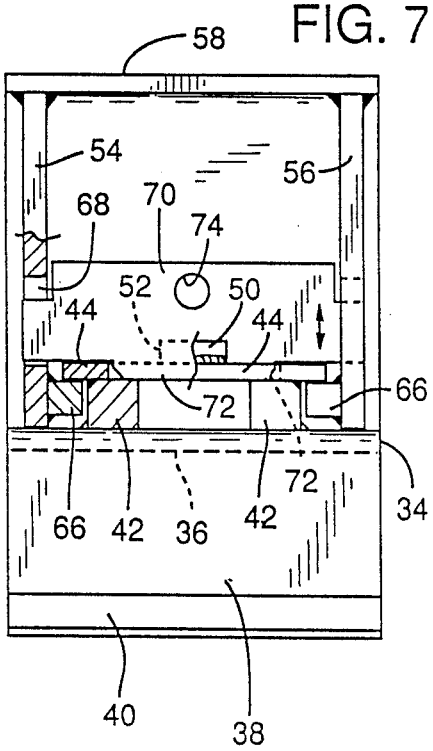
FIG. 7 is a rear elevational view of the guide and spacer device shown in FIGS. 3–6.

Referring now to the drawings, in FIG. 1 a container car unit 10 including a container well 12 is shown with a container 14 in place in the container well 12. The car unit 10 may be one of a number of similar units joined as a multi-unit car by articulating couplings, with adjacent ends of such units supported by a single wheeled truck. Alternatively, the car unit 10 may have a conventional truck and a coupler located at each end.

The container well 12 has a width 16, defined by a pair of opposite side walls 18, which may, for example, be the side sills of the car unit 10. The width 16 is great enough to accept a container whose width is greater than the width 20 of the container 14. The container well 12 also has a length 22, defined between a pair of opposite end structures 23, which is great enough to accept a cargo container whose length is greater than the length 24 of the container 14. For example, the container well 12 may have a length 22 slightly greater than 48 feet and a width 16 slightly greater than 102 inches, in order to accept a cargo container whose nominal length is 48 feet and whose nominal width is 102 inches.

In order to retain the container 14 in a laterally central position within the container well 12, four adjustable spacer and guide devices 26 according to the present invention are located at respective positions atop the side walls 18 of the container car unit 10. Preferably, each of the spacer and guide devices 26 is located at a position corresponding to the location of a corner post or other vertically-extending strengthening member of a standard intermodal cargo container properly positioned in the container well 12. The cargo container 14 represents a standard 96-inch wide, 40-foot long cargo container having corner posts (not shown), and the spacer and guide devices 26 are located so as to be aligned with the corner posts when the cargo container 14 is in its proper location, where it is restrained against longitudinal movement within the container well 12 by well-known means such as locator cones 27 (FIG. 2) located in the bottom of the container well.

As may be seen in FIG. 1, a guide body portion 28 of each spacer and guide device 26 is positioned so as to extend inwardly beyond the sidewalls 18 into the container well 12, toward the 40-foot container 14, whose width 20 is nominally 96 inches. The spacer and guide device 26 prevents substantial lateral movement of the upper portion of the cargo container 14, which is narrower than the width 16 of the container well 12, in order to prevent the container 14 from tipping laterally and rolling out of the container well, as it might otherwise be able to do.

FIG. 2 shows a portion of the container car unit 10 in section view, without illustration of the supporting trucks, which do not form a portion of the present invention. Parts of a stacked pair of containers are shown in the left side of the container well, while parts of a stacked pair of intermodal cargo containers 30 are shown in the right side of the container well 12. The container 30 is wider than the container 14, having a width 31 which is only slightly less than the width 16 of the container well 12. A spacer and guide device 26 shown at the right side of FIG. 2 therefore has its guide body 28 in its outer position. The guide body 28 extends only a slight distance laterally into the container well 12, and thus does not obstruct placement of the lower container 30 into the container well 12, yet provides support to prevent the container 30 from tipping laterally.

A fixed, upwardly extending tent-shaped protective unit 32 is located midway along the length of each sidewall 18, as may be seen in FIG. 1. This unit serves the primary purpose of protecting the top of the side wall 18 from being damaged by container loading cranes, during operations of loading and unloading the car 10. It has a secondary purpose of providing an additional inclined su face with which a container may come into contact and thereby be guided toward the interior of the container well 12.

Referring now also to FIGS. 3–7, in FIG. 3 the guide and spacer device 26 is shown, with the guide body 28 shown in its outer position in solid line, and in its laterally inwardly displaced inner position in broken line. The guide and spacer device 26 includes a base 34, which preferably includes a bent base plate having a generally horizontal top portion 36, a downwardly directed outer leg 38, and a downwardly directed inner leg 40, which may be sloped to present a downwardly facing surface which slopes upwardly and toward the center of the container well 12. The outer and inner legs 38 and 40 are preferably welded to the upper portion of the respective side wall 18, leaving an open space beneath the top portion 36.

A pair of risers 42 are welded to the top portion 36, extending transversely with respect to the length of the car unit 10. A detent plate 44 is welded atop the risers 42, which preferably have a beveled edge to define a location for a notch weld, to attach the detent plate 44 to the risers 42 so that it extends beyond each of the risers 42 in the longitudinal direction. The detent plate 44 thus includes an overhanging part near each end of the container guide and spacer device 26.

As may be seen best in FIG. 5, the detent plate 44 defines a pair of elongated detent sockets, an inner socket 46 and an outer socket 48, which have the form of a slot extending through the detent plate and oriented longitudinally of the guide and spacer device 26. An outer stop 50, which may be of square bar stock, is fastened, as by welding, to the detent plate 44 at the outer side of the outer socket 48. An inner stop 52, which is a square piece of plate material, is welded to the top of the detent plate 44, overhanging its inner edge, so as to lie alongside the inner side of the inner socket 46. It will be appreciated that for ease of assembly it may be desirable to weld the inner stop 52 to the detent plate 44 only after the guide body 28 has been fitted to the base 34.

The guide body 28 is slidably disposed on the base 34, and is constructed of a pair of end plates 54 and 56, which have horizontal bottom surfaces resting slidably atop the upper surface of the top portion 36. A face plate 58 is fixedly attached, as by welding, to both of the end plates 54 and 56, holding them vertical and parallel with one another. The face plate 58 includes a horizontal top portion and a downwardly and inwardly sloped generally planar container guiding surface 60, and extends smoothly into a generally cylindrically curved spacer nose 62 located at the lower side of the container guiding surface 60. The face plate 58 extends further downward beyond the nose 62, sloping outwardly, toward the inner leg 40 of the base 34 and presenting a surface 64 facing downwardly and inwardly toward the center of the container well 12.

A slide guide 66, which may be of square bar stock, is welded or otherwise permanently attached to each of the end plates 54 and 56, extending toward the adjacent one of the risers 42, beneath the detent plate 44, to attach the guide body 28 slidably to the base 34. Preferably, the slide guides 66 are located low enough on the end plates 54 and 56 to provide ample room to prevent binding between the guide body 28 and the base 34, and, similarly, the end plates 54 and 56 are spaced far enough apart from each other to prevent them from binding on the edges of the detent plate 44.

Each of the end plates 54 and 56 defines a vertically extending slot 68 extending upwardly above the height of the top surface of the detent plate 44. A latching bar 70 of flat plate material extends between the end plates 54 and 56, with a respective end of the bar 70 extending within the slot 68 of each of the end plates 54 and 56 and being vertically movable to a limited extent. A bit 72 is centrally located on the bar 70 and extends downwardly to be received in a selected one of the inner and outer sockets 46 and 48 when the bar 70 is lowered. Each of the slots 68 extends a sufficient distance upwardly above the height of the detent plate 44 to permit the bar 70 to be raised sufficiently to withdraw the bit 72 from either of the inner and outer sockets 46 and 48, but prevent the bar 70 from being lifted high enough to permit the bit 72 to pass over either of the outer and inner stops 50 and 52. Preferably a hole 74 is defined in the bar 70 to be used to grasp the bar 70 to raise it to disengage the bit 72 from one of the inner and outer sockets 46 and 48 as required.

When the bit 72 is engaged in the inner socket 46, the guide body 28 is located in its inner position, projecting laterally inward beyond the side wall 18 toward the center of the container well 12, as shown in the left side of FIG. 2. With the guide body 28 of each container guide and spacer device 26 of a container well 12 in this inner position, the container guiding surfaces 60 can guide the container 14 to the proper location between the opposite side walls 18 of the car unit 10. The locator cones 27 can then fit appropriately into the sockets provided on the bottom of a container 14 of the usual 96 inch width, when the container 14 is lowered into the container well 12.

The sloping disposition of the inner leg 40 and of the sloping lower surface 64 of the guide body 28 are provided to assure that a corner casting or other slightly protruding part of a container 14 or 30 does not become snagged on the inner surfaces of the container well 12 and cause difficulty in removing a container 14 or container 30 from the container well 12.

The rounded nose portions 62 of each of the guide bodies 28 are located adjacent respective opposite sides of the container 14 and will prevent the upper portion of the container from being able to move laterally far enough to roll out of its central position in the container well 12. Preferably, the spacing between the opposite nose portions of the opposite guide and spacer devices 26 will be only slightly more than the nominal width 20 of the cargo container 14, giving, for example, from ½ inch to 1 inch of clearance on each side. The container 14 will then be able to slide down between the guide and spacer devices 26 into the container well 12, but will not be free to move laterally to any appreciable extent while it is carried in the car unit 10. The location of the nose portion provides a somewhat longer lever arm about the bottom outer edge 81 of the container 14 to resist tipping of the container 14 relative to the car unit 10 than would the top of the side walls 18.

The distance between the inner socket 46 and the outer socket 48 will depend upon the difference between the width 20 of the container 14 and the greater width 76 of the container 30, for example nominally 102 inches. The width 16 of the container well 12 will ordinarily be slightly greater than the width 76, in order to accommodate the unavoidable flexing of the car unit 10 during operation and in order to account safely for any variations of dimensions resulting during the construction of the car unit 10. Accordingly, the outer socket 48 is located so that when the guide body 28 is withdrawn laterally outwardly to permit the bit 72 of the bar 70 to be placed into the outer socket 48, the spacer nose 62 protrudes slightly beyond the inner surface of the side wall 18, providing a gap 78 (FIG. 2) between the side wall 18 and a wider container 30, which is smaller than the gap 80 between the inner surface of a side wall 18 and the surface of a container 14 of a narrower width.

When the guide body 28 is in the outer position, as shown in FIG. 3, the guiding surface 60 is upwardly exposed beyond any other structure of the car unit 10 which would ordinarily be contacted by a container 30 being lowered into the container well 12. The guiding surface is presented in an inwardly and downwardly inclined orientation, directed toward the interior of the container well 12, so that the bottom outer edge 82 of a container 30 which may be slightly out of alignment with the side walls 18 of the container well 12 will encounter the guiding surface 60, and thereafter will slide inwardly down its slope toward the center of the container well 12. The spacer nose 62, because of its location being higher than that of the top of the side walls 18, is in position to contact a vertical side of a container 30 to prevent it from sliding or rocking laterally within the container well 12, and is able to present a longer lever arm about a bottom outer edge 82 of a container 30 in opposition to such movement than would be presented by the top of the sidewall 18.

Ordinarly, it would be expected that the guide body 28 would be slid to the laterally inner position shown in FIGS. 1, 4, 5, and 6 prior to loading of a container 14 into container well 12. However, should the guide body 28 inadvertently not have been moved to the proper position, it can be slid to the inner position, even when a narrower container 14 is already in place within the container well 12, since the maximum laterally inward projection of the nose portion 62 occurs when the guide body 28 is in the inner position as shown in FIGS. 1, 4, 5, and 6. No other part of the guide and spacer device 26 ever projects further laterally inward, in any position of the guide body between its inner and outer positions. As a result, it is unnecessary to remove a narrower container such as the container 14 from the container well 12 in order to move the guide body 28 to the inner position. However, once the guide body 28 has been placed in either the inner or the outer position it will be held there securely there by the latching interaction of the bit 72 and the latch receiving socket 46 or 48 defined by the detent plate 44 of the base 34.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An adjustable guide and spacer device for a container well of a railroad car, comprising:

(a) a base;

(b) a guide body, supported by said base and having an inner side and an outer side, said guide body being movable translationally with respect to said base, between an outer position and an inner position in which a portion of said guide body projects beyond said base, said guide body including an upwardly exposed container guiding surface, said container guiding surface being sloped downwardly and in the direction of said inner side; and (c) latch means for latching said guide body in a selected one of said inner and outer positions.

2. The adjustable guide and spacer device of claim 1, wherein said guide body projects beyond said base by a maximum amount when said guide body is in said inner position.

3. The adjustable guide and spacer device of claim 1 wherein said latch means includes a reciprocally movable element carried on said guide body, and means located on said base for defining socket means for receiving a part of said reciprocally movable element when said guide body is in one of said inner and outer positions.

4. The adjustable guide and spacer device of claim 3 wherein said reciprocally movable element is a bar and includes a bit, and wherein said socket means includes at least two separate sockets, for receiving said bit, respectively, when said guide body is in said inner and outer positions.

5. The adjustable guide and spacer device of claim 4 wherein said guide body defines slot means for holding said bar slidably engaged with and carried in said guide body while said bar remains movable between a first position in which said bit is engaged in a selected one of said sockets and a second position in which said bit is disengaged from said sockets.

6. The adjustable guide and spacer device of claim 5 wherein said guide body includes a pair of oppositely located end members and said slot means comprises a generally vertical slot defined in each of said end members, said bar being disposed so as to be slidable in said slots to engage said bit in a respective one of said sockets.

7. The adjustable guide and spacer of claim 1 wherein said guide body includes a blunt nose having a convex surface located downwardly adjacent said container guiding surface, said nose being disposed laterally in the direction of said inner side.

8. The adjustable guide and spacer device of claim 1 wherein said base includes means for mounting said guide and spacer device atop a side wall defining a container well of a railway freight car.

9. In a railroad car including a pair of laterally separated longitudinally extending side walls defining the width of a container well having an interior for receiving cargo containers of various widths, an improved container guide and spacer device, comprising:

(a) a base mounted on one of said side walls;

(b) a guide body, supported by said base and having an inner side and an outer side, said guide body being movable translationally with respect to said base, between an outer position and an inner position in which a portion of said guide body projects laterally inwardly beyond said one of said side walls, said guide body including an upwardly exposed container guiding surface, said container guiding surface being sloped downwardly toward the interior of said container well; and (c) latch means for latching said guide body in a selected one of said inner and outer positions.

10. The railroad car of claim 9 wherein said guide body is in a position of substantially maximum inward protrusion with respect to said side wall when said guide body is in said inner position.

11. The railroad car of claim 9 wherein said latch means includes a reciprocally movable element carried on said guide body and means connected with said base, for defining socket means for receiving a part of said reciprocally movable element when said guide body is in on of said inner and outer positions.

12. The railroad car of claim 11 wherein said reciprocally movable element is a bar and includes a bit and wherein said socket means includes at least two separate sockets, for receiving said bit, respectively, when said guide body is in said inner and outer positions.

13. The railroad car of claim 12 wherein said guide body defines slot means for holding said bar slidably engaged with and carried in said guide body while said bar remains movable between a first position in which said bit is engaged in a selected one of said sockets and a second position in which said bit is disengaged from said sockets.

14. The railroad car of claim 13 wherein said guide body includes a pair of oppositely located end members and said slot means comprises a generally vertical slot defined in each of said end members, said bar being disposed so as to be slidable in said slots to engage said bit in a respective one of said sockets.

15. The railroad car of claim 9 wherein said guide body includes blunt nose means having a convexly arcuate surface located downwardly adjacent said container guiding surface, said nose means being disposed laterally inwardly of said container well side wall so as to face toward a side of a container located therein, for preventing more than a predetermined amount of lateral movement of said container within said container well.

16. In a railroad car including a pair of laterally separated longitudinally extending side walls defining the width of a container well having an interior for receiving cargo containers of various widths, an improved container guide and spacer device, comprising:

(a) a base mounted on one of said side walls;

(b) a guide body, supported by said base and having an inner side and an outer side, said guide body being movable with respect to said base, between an outer position and an inner position in which a portion of said guide body projects laterally inwardly beyond said one of said side walls, said guide body including an upwardly exposed container guiding surface, said container guiding surface being sloped downwardly toward the interior of said container well; and (c) latch means for latching said guide body in a selected one of said inner and outer positions, said latch means including a reciprocally movable bar carried on said guide body and including a bit, and means connected with said base for defining socket means for receiving said bit when said guide body is in one of said inner and outer positions, said socket means including at least two separate sockets, each for receiving said bit when said guide body is in a respective one of said inner and outer positions.

17. The railroad car of claim 16 wherein said guide body defines slot means for holding said bar slidably engaged with and carried in said guide body while said bar remains movable between a first position in which said bit is engaged in a selected one of said sockets and a second position in which said bit is disengaged from said sockets.

18. The railroad car of claim 17 wherein said guide body includes a pair of oppositely located end members and said slot means comprises a generally vertical slot defined in each of said end members, said bar being disposed so as to be slidable in said slots to engage said bit in a respective one of said sockets.

19. An adjustable guide and spacer device for a container well of a railroad car, comprising:

(a) a base;

(b) a guide body, supported by said base and having an inner side and an outer side, said guide body being movable with respect to said base, between an outer position and an inner position in which a portion of said guide body projects beyond said base, said guide body including an upwardly exposed container guiding surface, said container guiding surface being sloped downwardly and in the direction of said inner side; and (c) latch means for latching said guide body in a selected one of said inner and outer positions, said latch means including a reciprocally movable bar carried on said guide body and including a bit, and means connected with said base for defining socket means for receiving said bit when said guide body is in one of said inner and outer positions, said socket means including at least two separate sockets, each for receiving said bit when said guide body is in a respective one of said inner and outer positions.

20. The adjustable guide and spacer device of claim 19 wherein said guide body defines slot means for holding said bar slidably engaged with and carried in said guide body while said bar remains movable between a first position in which said bit is engaged in a selected one of said sockets and a second position in which said bit is disengaged from said sockets.

21. The adjustable guide and spacer device of claim 20 wherein said guide body includes a pair of oppositely located end members and said slot means comprises a generally vertical slot defined in each of said end members, said bar being disposed so as to be slidable in said slots to engage said bit in a respective one of said sockets.

22. The adjustable guide and spacer device of claim 1 wherein said guide body is slidably supported atop said base for movement therealong between said outer position and said inner position.

23. The railroad car of claim 9 wherein said guide body is slidably supported on said base for movement therealong between said outer position and said inner position.

24. An adjustable guide and spacer device for a container well of a railroad car, comprising:

(a) a base;

(b) a guide body, supported atop said base and having an inner side and an outer side, said guide body being slidably mounted on said base for movement with respect thereto, between an outer position and an inner position in which a portion of said guide body projects beyond said base, said guide body including an upwardly exposed container guiding surface and a laterally exposed blunt nose, said container guiding surface being sloped downwardly and in the direction of said inner side; and (c) latch means for selectively latching said guide body in each of said inner and outer positions.

* * * * *

UNITED STATES PATENT AND TRADEMARK OFFICE

CERTIFICATE OF CORRECTION

PATENT NO. : 4,930,426

DATED : June 5, 1990

INVENTOR(S) : Gregory J. Saxton et al.

It is certified that error appears in the above-identified patent and that said Letters Patent is hereby corrected as shown below:

| | |
|---|---|
| Col. 1, line 58 | Change "a" to --an--. |
| Col. 4, line 29 | After "4" insert --.--. |
| Col. 5, line 44 | Change "su face" to --surface--. |
| Col. 7, line 7 | Number "96" should not be in bold print. |
| Col. 9, line 48 | Change "on" to --one--. |

Signed and Sealed this

First Day of September, 1992

*Attest:*

DOUGLAS B. COMER

*Attesting Officer*

*Acting Commissioner of Patents and Trademarks*